US006851371B1

(12) United States Patent
Wah

(10) Patent No.: US 6,851,371 B1
(45) Date of Patent: Feb. 8, 2005

(54) FOLDABLE FIREWORK BASE

(75) Inventor: Ng Wing Wah, South Horizons (HK)

(73) Assignee: Shiu Fung Fireworks, Inc. (HK)

( * ) Notice: Subject to any disclaimer, the term of this patent is extended or adjusted under 35 U.S.C. 154(b) by 0 days.

(21) Appl. No.: 10/770,975

(22) Filed: Feb. 3, 2004

(51) Int. Cl.[7] ..... F42B 4/26
(52) U.S. Cl. ..... 102/343; 102/349; 102/358
(58) Field of Search ..... 102/349, 343, 102/358, 361; 248/346.01, 146, 346.03

(56) References Cited

U.S. PATENT DOCUMENTS

| | | | | |
|---|---|---|---|---|
| 2,053,454 A | * | 9/1936 | Whiteside | 248/524 |
| 2,095,490 A | * | 10/1937 | Decker | 89/1.819 |
| 5,028,023 A | * | 7/1991 | Allen | 248/152 |
| 5,979,329 A | | 11/1999 | Collar | |
| 6,457,415 B1 | | 10/2002 | Peter Sung Yan | |

FOREIGN PATENT DOCUMENTS

| | | | |
|---|---|---|---|
| JP | 2001241897 A | | 9/2001 |
| JP | 2002-90098 | * | 3/2002 |
| JP | 2003-12069 | * | 1/2003 |

* cited by examiner

*Primary Examiner*—Teri P. Luu
*Assistant Examiner*—T. Nguyen
(74) *Attorney, Agent, or Firm*—John C. McMahon

(57) ABSTRACT

A launching device for launching multiple firework shells skyward th a base having foldable wings hinged to a central body. The foldable wings fold downward and reduce the size of the base for the purpose of providing a low-profile profile shipping configuration. The base has a connector, such as an engagement cylinder, that matingly engages an elongated or tubular member that is sized and shaped to receive aerial fireworks. The engagement cylinder provides either a male or female engagement with the tubular member. An adapter is provided to adjust the diameter of the connector to fit tubes of different diameter.

13 Claims, 2 Drawing Sheets

FOLDABLE FIREWORK BASE

BACKGROUND OF THE INVENTION

The present invention is directed to fireworks and support structures therefor and, more specifically, to an improved fireworks base having hinged wing sections that are foldable to allow a smaller package and shipping profile of fireworks.

Aerial display fireworks that are used by non professional consumers are normally launched from tubes mounted on a freestanding base. For such fireworks to be used safely, launching platforms for the aerials must be designed to meet certain safety criteria, including that launching tubes not explode and that bases provide a stable platform for launching the fireworks. In particular, fireworks designed to be launched by a base and tubular structure that aim and discharge the aerial fireworks into the air need to have a minimum foot print or base size that engages the ground for support. The base size is designed to provide adequate support in order to insure that the launching tube does not upset or tip over during discharge and accidentally project its contents in an undesired sideways or lateral direction which could cause the fireworks to hit bystanders and/or create fire hazards by hitting houses, grassy areas or other highly flammable locations. Shipping or merchandising boxes or packaging must be large enough to receive the base and launching tube. Normally, the base is much wider than the remainder of the product in the packaging and this results in the packaging being much wider than is required for the rest of the product. Therefore, the packaging has a large amount (often half or more) of wasted space. This additional space translates into substantial additional shipping costs, which adversely affects costs of goods sold, rendering the final consumer cost of the product more expensive. This is especially true as many fireworks of this type which are sold in the United States are manufactured in the Orient and shipped as container freight across the Pacific Ocean. Because much of the volume of the packaging is wasted space, substantially more large containers must be used to ship the same number of packages, as compared to the number required to ship a smaller volume package, at substantial additional costs.

To reduce shipping costs, other types of products are often shipped disassembled requiring post-shipment assembly by the buyer or the consumer. In the field of aerial type fireworks, it is foreseen that a base could be physically removed from the tube and then both could be shipped in an upright, low-profile position. However, this would require the consumer to secure the tube to the base which is not a viable option, because the end-consumer might incorrectly assemble the launching device leading to an accident. Different degrees of assembly skill are found in consumers and many simply do not want to be bothered with assembly. Furthermore, if the base and tube are not assembled at the manufacturer, then the base may not be adequately or correctly attached and may separate from the tube structure during discharge of the aerial and project all or part of the fireworks in an undesired sideways or lateral direction and possibly toward bystanders and/or fire hazards. For this reason, base structures are normally permanently secured to their associated tube at the time of manufacture via adhesive, pinning or the like.

Accordingly, it is desirable to have such fireworks where the base and tube do not require crucial assembly by the consumers, yet wherein the overall product can be placed in a comparatively low profile package that is economical to ship and store. It is also desirable that such fireworks be lightweight, easy to use and inexpensive, so as to encourage consumers to acquire and use the product.

SUMMARY OF THE INVENTION

The present invention overcomes the problems previously described by providing a tube and base launching device for launching a series of aerial fireworks shells skyward. The base has foldable wings hinged to a central body. The foldable wings are placeable in a folded position during shipping to reduce the footprint size of the base for the purpose of providing a low-profile shipping configuration. Because the base is narrower, packing can also be narrower, thus reducing wasted space found in packaging of devices having non folding bases. The central body includes a structure to secure the tube to the body. In one embodiment, the securing structure is a connector comprising a projecting cylinder that matingly engages the inside of the tube. Such a cylinder can also be sized to engage the outside of the tube. The tube is sized and shaped to receive aerial fireworks. Alternatively, the securing structure may be a bore in the base for snugly receiving the tube. The tube is secured to the base by gluing, pinning or the like.

The central body and the wings have interlocking keepers for locking the wings into an extended and unfolded, use configuration. The wings are attached to the base by a hinge that folds so that the wings fold only downwardly relative to the central body, such that gravity also helps hold the wings in the use configuration when the base is placed on the ground. The wings have a connector with mating portions that are joined during transit for holding the wings in the folded position relative to the base.

The connector is provided with adjustment sleeves that allow a manufacture to utilize a single base with tubing of different sizes.

OBJECTS AND ADVANTAGES OF THE INVENTION

The principal objects of the present invention are to provide a launching device for aerial fireworks having a base that has a stable ground engaging footprint in use, but that is foldable into a low-profile shipping configuration; to provide such a base having sufficient stability to reasonably insure that each firework discharge is directed skyward; to provide such a base that is a single articulated unit; to provide such a base that is portable and reusable; to provide such a base that is manufactured out of material that is lightweight and will not form shrapnel or fragment into potentially harmful flying debris should the fireworks being used therewith malfunction and explode within the launching device; to provide such a base with a simple design that can be manipulated and placed in a use configuration by a consumer with ease; to provide such a base having a central projecting cylinder for mating with and being secured to a launching tube; to provide such a base having a projecting cylinder that can be adjusted to accommodate various tube sizes by use of adjusting sleeves or rings; to provide such a base that does not upset or tip over easily during use; to provide such a base wherein wings are attached to a central body by downward facing hinges so that the wings are held in place in an unfolded or use configuration by gravity when the launching device is placed on the ground; to provide such a base wherein frictional catches or straps are utilized between the base central body and each wing to help hold the wings in the unfolded use configuration; and to provide such a base which is relatively easy to use, inexpensive to produce and particularly well-suited for its intended usage.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
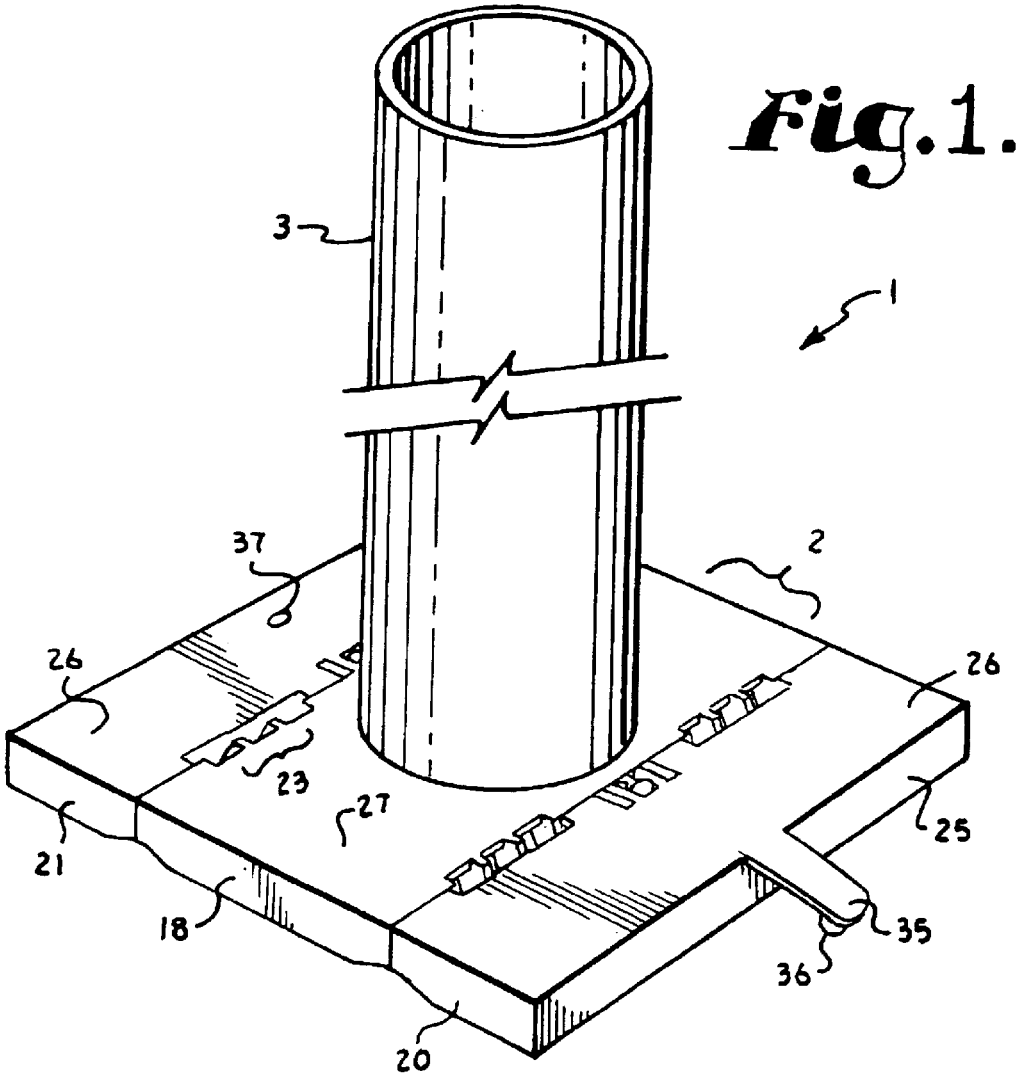
FIG. 1 is a perspective view of an aerial fireworks launching device having a base and a tube in a use configuration and in accordance with the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally identifies a fireworks launching device in accordance with the present invention. The launching device 1 includes a base 2 and a tubular structure 3 that is attached to the base 2 by a tube insert or connector 4. The tubular structure 3 is sized and shaped to receive aerial fireworks shells 8, which are of a type that are common and easily accessible in the fireworks marketplace.

Figure 4:
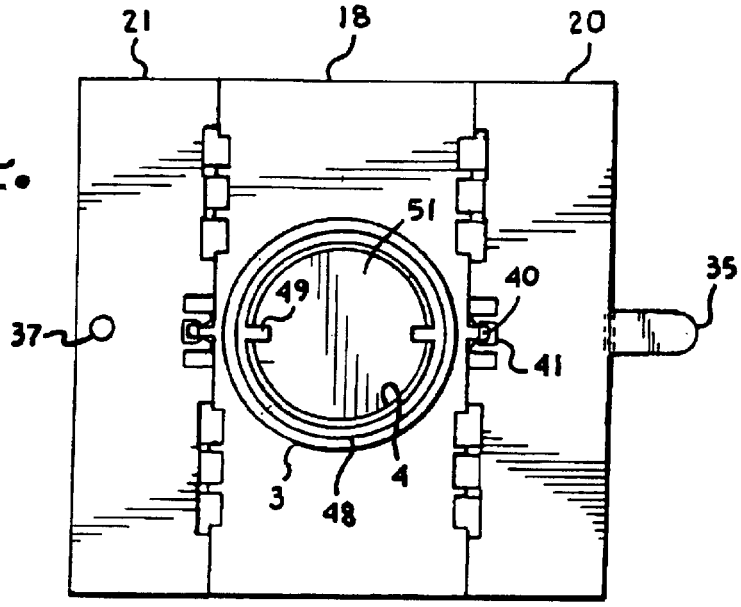
FIG. 4 is a top plan view of the fireworks launching device in a use configuration.
Figure 2:
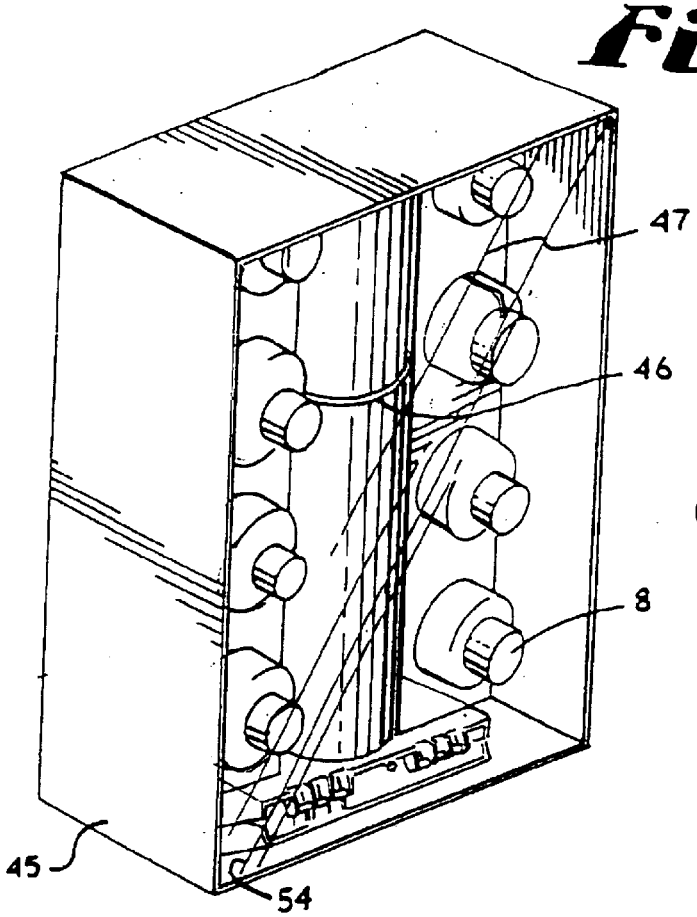
FIG. 2 is a perspective view of the launching device in a folded shipping configuration in a shipping container thereof with aerial fireworks that are launchable from the device.
Figure 3:
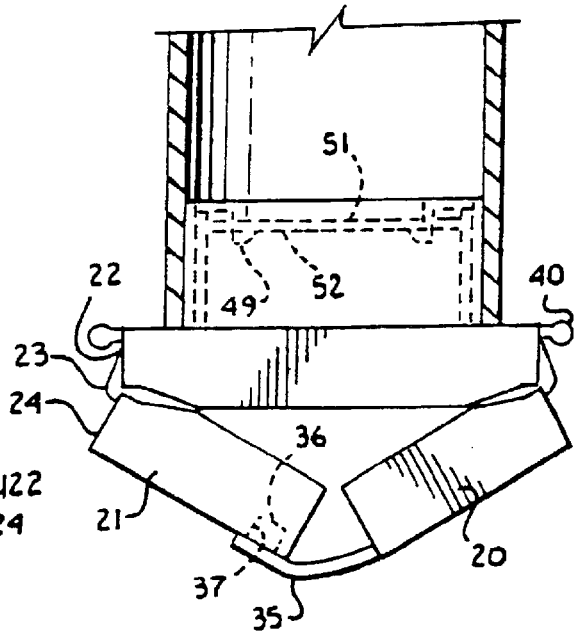
FIG. 3 is a side elevational view of the launching device in the shipping configuration with the tube broken away to show an internal projecting cylinder in phantom that joins the base and tube and a size adjustment sleeve.

The base 2 has a central section 18 and a pair of foldable wings 20 and 21 that project laterally from the central section 18. The foldable wings 20 and 21 are hinged to the central section 18 by hinges 23 and fold downwardly from a use configuration, shown in FIG. 1, to a folded or shipping configuration, shown in FIGS. 2 and 3. In the use configuration, the wings 20 and 21 are extended and combine with the base 2 to produce a front to back (top to bottom in FIG. 4) and side to side (left to right in FIG. 4) footprint of approximately 4.875 by 4.875 inches. In the shipping configuration, the wings 20 and 21 are folded to produce a footprint of approximately 4.875 by 2.375 inches, which are also the horizontal dimensions for the central section 18. The base central section 18 has side walls 22 that have a generally planar and vertically aligned outer surface during usage.

Figure 5:
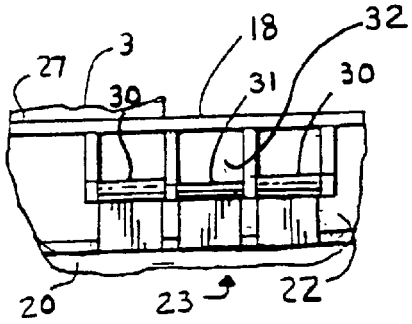
FIG. 5 is a fragmentary front elevational view of the launcher showing a hinge with the base in the shipping configuration.

The wings have inner walls 24 and outer walls 25. The hinges 23 are designed and located so that the outer walls 25 of the wings 20 and 21 only fold downwardly relative to the base central section 18. The wing inner wall 24 and the central section side walls abut when upper surfaces 26 of the wings 20 and 21 become coplanar with upper surface 27 of the central section 18 and prevent the wings 20 and 21 from rotating further, although return to the folded configuration is possible. The hinges 23, see FIG. 5, include loop members 30 on the central section 18 that go around an appropriately located bar 31 on each of the wings 20 and 21 and stops 32 wherein each is located between a pair of spaced loop members 30 and each abuts a respective intermediate bar 31 to prevent the wings 20 and 21 from inadvertently becoming removed from the central section 18 after the wings 20 and 21 are mounted on the central section 18.

To stabilize the device 1 during shipment and to secure the wings 20 and 21 in the shipping configuration, there is a tether or strap 35 that, when in use, engages and holds the wings 20 and 21 together in the folded configuration and provides secure packaging. In the present embodiment, the strap 35 is attached to and projects from the wing 20 and has a button cylindrical projection 36 that is located on a distal end thereof. The opposite wing 21 includes an opening 37 sized and shaped to receive the button 36 and to frictionally but removably hold the button 36.

When a user desires to operate the fireworks launching device 1, the button 36 is pulled from the opening 37 and the strap 35 is released and the wings 20 and 21 are free to rotate under manual control of the user outward from the folded configuration into the use configuration, as depicted in FIG. 1.

The wings 20 and 21 each have a projecting keeper knob or sphere 40 that matingly engages a pair of interference fit arms or frictional receptacles 41 in the sides of the central section 18. As the fireworks launching device 1 is transformed from the shipping configuration to the use configuration, the wings 20 and 21 are extended causing the surfaces 26 and 27 to become coplanar and the spheres 40 to matingly engage the receptacles 41 in an interference fit. The joining of the sphere 40 and receptacles 41 resist folding of the wings 20 and 21 relative to the central section 18, thus enforcing the stability of the fireworks launching device 1 and reducing the likelihood that the wings 20 and 21 will undesirably fold when the user is trying to place the device 1 on the ground for use. Furthermore, placement of the fireworks launching device 1 on the ground aids in securing the wings 20 and 21 in the use configuration as gravity urges the center section 18 downwardly thus resisting folding of the wings 20 and 21. The frictional engagement between the spheres 40 and receptacles 41 is easily overcome by manual pressure exerted by the user, if the user wishes to return the device to the folded configuration for storage or the like.

The connector 4 of the present embodiment is cylindrically shaped and approximately 0.75 inches in length, but may vary depending on the length that is sufficient to provide sealing engagement and support of the tubular structure 3. It is foreseen that a lip (not pictured) can be added that projects upwards from the base 2 or radially from the connector 4 to provide additional sealing engagement between the tubular structure 3 and connector 4. In the present embodiment, the connector 4 has an outer diameter of approximately 1.6875 inches for mating with a tubular structure 3 with a similar inner diameter, but can accommodate tubular structures 3 of varying sizes with the use of a width-accommodating expansion member or adapter 48 that can be selectively employed during manufacture.

While it is foreseen that the adapter 48 can be of varying thickness for accommodating a plurality of tubular members 3, in the present embodiment, the adapter 48 is a sleeve that fits snugly over the connector 4 and increases the outer diameter of the connector 4 to approximately 1.8125 inches for accommodating a tubular structure 3 with a corresponding inner diameter. The adapter 48 has a set of hook like keepers 49 and an inner diameter and shape to slidably engage the connector 4. The connector 4 has an upper surface 51 with a set of openings or receiver slots 52. The slots 52 line up with and engage the keepers 49 to further secure and lock the adapter 48 onto the connector 4.

During manufacturing, the assembler determines the appropriate length of connector 4 to provide sufficient strength to support the selected tubular structure 3. The connector 4 is preferably molded as part of the base 2, if the device is constructed of plastic. The connector 4 may also be secured to the base 2 by adhesive or other appropriate and well known methods.

During assembly of the device, the assembler will select the appropriately sized adapter 48, if required, that functions as an adjustment sleeve, if the tubular structure 3 has a larger inner diameter than the outside diameter of the connector 4. Thereafter, the tubular structure 3 is fitted to the connector 4 and, if applicable, to the adapter 48 by the use of an adhesive, pinning or other suitable attachment material or structure. The wings 20 and 21 are folded into the shipping configuration and secured by the strap 35. Due to the smaller footprint yielded by the shipping configuration, the device 1 is capable of utilizing a smaller and more efficient shipping box 45 that snugly fits the side to side width of the base central section 18. Preferably, the box 45 has a shipping strap 46 that secures the tubular structure 3 to packing 47 that also supports the shells 8 to further secure the device 1 during shipment. It is also desirable to package and distribute the device 1 with the firework shells 8, as depicted in FIG. 1 in order to provide the user with firework shells 8 of an ideal quantity to deter over-use of the device 1 and an ideal size and shape to properly fit the tubular structure 3. The illustrated shipping box 45, also functions as a sales box and has a clear or see through side 54 that allows a potential buyer to view the aerial fireworks shells 8 and the launching device 1.

In use, the user extracts the device 1 from the shipping box 45 by releasing the shipping strap 46. Thereafter, the wing strap 35 is released allowing the wings 20 and 21 to be pivoted and rotated under the guidance and control of the user, so that the surfaces 26 and 27 become coplanar. The user positions the fireworks launching device 1 onto the ground, which further supports the device 1 at which point the device 1 is ready to receive the firework shells 8.

Figure 6:
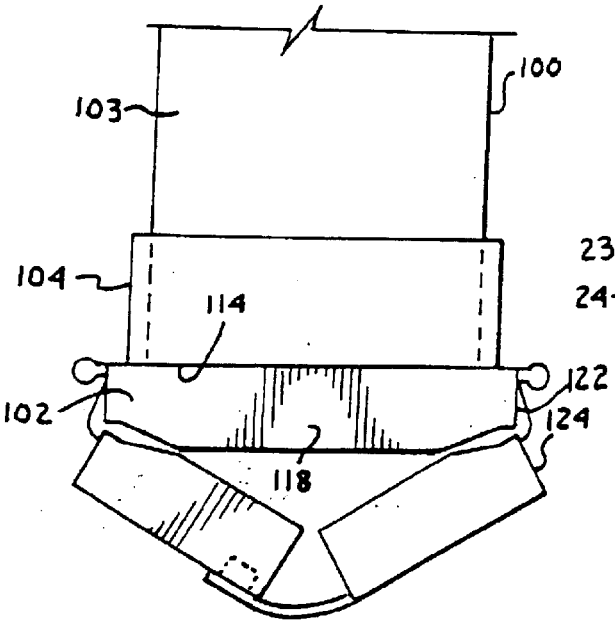
FIG. 6 is a side elevational view of a first modified embodiment of a launching device in accordance with the present invention.

A second embodiment of a device 100 in accordance with the present invention is depicted in FIG. 6. The device 100 has many elements that are the same as those shown in the first embodiment of FIGS. 1 to 5 and those elements, therefore, will not be extensively discussed, but rather the differences are discussed with particularity herein. The second embodiment includes a base 102, a tube 103 and a connector 104. The connector 104, annular in shape has a bottom 114 that is attached to a central section 118 of the base 102. The base 102 has a pair of wings 120 that abut at surfaces 122 and 124. As opposed to the first embodiment where the tubular structure 3 is connected to the connector 4 via a male mating engagement, that is, where the tubular structure 3 fits around and encompasses the connector 4, in the second embodiment, the tubular structure 103 is connected to the connector 104 via a female mating engagement, that is, the tubular structure 103 is inserted within the connector 104 which fits around and encompasses the tubular structure 103. The connector 104 is fixedly secured to both the base 102 and the tube 103 via adhesive, pinning or the like.

In either embodiment, it is foreseen that the nature of the connectors 4 and 104 inherently provide engagement with and connection to the tubular structure 3 and 103 via a male or female engagement, that is the tubular structures 3 and 103 can fit within or outside of the connectors 4 and 104. It is also foreseen that the tube could be connected to the base by implanting the tube in a depression or cylindrical bore in the base and securing the tube in the base via adhesive, pinning or the like.

It is to be understood that while certain forms of the present invention have been illustrated and described herein, it is not to be limited to the specific forms or arrangement of parts described and shown.

What is claimed is:

1. A fireworks launching device comprising:

a) a ground engaging base having a tube support structure and a wing; said wing being joined by a hinge to said tube support structure so as to be foldable beneath said tube support structure; said wing being folded to facilitate shipping and unfolded for use;

a sidewall associated with said wing and operably abutting a sidewall associated with the tube support structure so as to prevent said wing from folding on said hinge above said tube support structure, so that said tube support structure and said wing form a solid support when said wing is unfolded and said device is placed on a ground surface; and c) a tubular member mounted to project upwardly from said base and adopted to receive and launch aerial fireworks.

2. The device according to claim 1 wherein:

a) said tube support structure is a central structure; said wing is a first wing and including a second wing foldably joined to said central structure opposite said first wing; and wherein;

b) said wings can be selectively manipulated between a folded, low-profile shipping configuration and an extended, use configuration.

3. The device according to claim 2 wherein:

a) said wings are each hinged to the central tube support structure by a hinge that allows said wings to rotate between said shipping configuration and said use configuration and including stops that operably prevent each of said wings from rotating above said use configuration wherein said wings and said tube support structure have ground engaging generally co planar surfaces.

4. The device according to claim 1 including:

a) a connector joining said tubular member to said base.

5. In an aerial fireworks launching device for launching multiple aerials in succession skyward; the improvement comprising:

a) said device including a ground engaging support base with a foldable wing that is adjustable between a folded position under said base to provide a low profile during shipment and an extended position wherein the lower side of the wing is generally planar with respect to an underside of the base so as to provide support during use and a first sidewall on said base and a second sidewall on said wing that abut in the extended position to prevent said wing from folding above said base.

6. A launching base adapted to supporting a tube for launching multiple firework shells skyward from the base having a pair of opposed wings hinged to a central body that are foldable between a first position beneath the central body and a second position wherein said body is generally parallel to each of said wings and each wing has an associated first sidewall and said body has an associated second sidewall that abut when in said second position to prevent the wing from folding to a position above said central body.

7. A fireworks launching device comprising:

a) a ground engaging base having a tube support structure and a wing;

b) said tube support structure is a central structure;

c) said wing being foldable relative to said tube support structure; said wing being folded to facilitate shipping and unfolded for use;

d) said wing is a first wing and including a second wing foldably joined to said central structure opposite said first wing;

e) said wings being selectively manipulatable between a folded, low-profile shipping configuration and an extended, use configuration;

f) said wings being hinged to the central structure by a hinge that allows said wings to rotate between said shipping configuration and said use configuration;

g) said central structure has side walls and said wings have inner walls that abut when said wings are in said use configuration and prevent said wings from folding upwardly relative to said central structure; and h) a tubular member mounted to project upwardly from said base and adopted to receive and launch aerial fireworks.

8. A fireworks launching device comprising:

a) a ground engaging base having a tube support structure and a wing; said wing being foldable relative to said tube support structure; said wing being folded to facilitate shipping and unfolded for use;

b) a tubular member mounted to project upwardly from said base and adapted to receive and launch aerial fireworks;

c) a connector joining said tubular member to said base; and d) said connector being a cylinder that is fixedly secured to and projects upward from said base and receives said tubular member around.

9. The device according to claim 8 including:

a) an adapter sized and shaped to be received on said connector and utilized to operably selectively vary a diameter of the connector for accommodating tubular members of varying diameters.

10. The device according to claim 9 wherein:

a) said adapter is slidably and snugly received by the connector.

11. The device according to claim 10 further comprising:

a) at least one keeper that protrudes from the adapter to matingly engage the connector for locking the adapter into a use position on the connector.

12. A fireworks launching device comprising:

a) a ground engaging base having a tube support structure and a wing; said wing being foldable relative to said tube support structure; said wing being folded to facilitate shipping and unfolded for use;

b) a tubular member mounted to project upwardly from said base and adapted to receive and launch aerial fireworks;

c) a connector joining said tubular member to said base; and d) said connector is an annulus that projects upward from said base and receives said tubular member therein.

13. A fireworks launching device comprising:

a) a ground engaging base having a tube support structure and a wing; said wing being foldable relative to said tube support structure; said wing being folded to facilitate shipping and unfolded for use;

b) a tubular member mounted to project upwardly from said base and adapted to receive and launch aerial fireworks; and c) an interference fit structure that protrudes from a first of the central structure and the wing and positioned to matingly engage a receiver on a second of the central structure and the wing when the wing is in the use configuration.

* * * * *